US006765160B1

(12) United States Patent
Robinson

(10) Patent No.: US 6,765,160 B1
(45) Date of Patent: Jul. 20, 2004

(54) OMNIDIRECTIONAL MICROSCALE IMPACT SWITCH

(75) Inventor: Charles H. Robinson, Silver Spring, MD (US)

(73) Assignee: The United States of America as represented by the Secetary of the Army, Washington, DC (US)

( * ) Notice: Subject to any disclaimer, the term of this patent is extended or adjusted under 35 U.S.C. 154(b) by 50 days.

(21) Appl. No.: 10/064,828

(22) Filed: Aug. 21, 2002

(51) Int. Cl.[7] ..... H01H 29/02; H01H 29/06

(52) U.S. Cl. ..... 200/61.45 R; 200/61.48; 73/514.16

(58) Field of Search ..... 200/61.45 R, 61.48, 200/61.49, 61.51, 61.52, 181; 73/514.16, 514.29, 514.35, 514.36, 514.37, 514.38

(56) References Cited

U.S. PATENT DOCUMENTS

| | | | | | |
|---|---|---|---|---|---|
| 5,818,227 | A | * | 10/1998 | Payne et al. | 324/259 |
| 5,952,572 | A | * | 9/1999 | Yamashita et al. | 73/504.04 |
| 6,105,427 | A | * | 8/2000 | Stewart et al. | 73/514.32 |
| 6,273,514 | B1 | * | 8/2001 | Hulsing, II | 310/306 |
| 6,367,786 | B1 | * | 4/2002 | Gutierrez et al. | 267/136 |

* cited by examiner

*Primary Examiner*—Lincoln Donovan
*Assistant Examiner*—K. Lee
(74) *Attorney, Agent, or Firm*—John F. Moran

(57) ABSTRACT

The invention is a normally-open, momentary, non-latching, inertial thresholding switch 30, fabricated on a substrate 1 in a planar configuration, using no cylindrical tilt mass, with low mass 16 and small switch gap 36, 37, 38, 39 to allow fast switch action and rapid reset. Of ultra-miniature, rugged construction, its high mechanical frequency limits sensitivity to vibration inputs.

12 Claims, 7 Drawing Sheets

OMNIDIRECTIONAL MICROSCALE IMPACT SWITCH

FEDERAL RESEARCH STATEMENT

[The inventions described herein may be manufactured, used and licensed by or for the U.S. Government for U.S. Government purposes.]

BACKGROUND OF THE INVENTION

The invention relates in general to inertial switches and in particular to very small electro-mechanical inertial switches.

To assure safety in the transportation, handling, and deployment of gun-fired and other explosive munitions, munition-fuze safety standards require that two unique and independent aspects of the launch environment must be detected in the weapon fuze system before the weapon can be enabled to arm. Examples of the aspects of the launch environment that are sensed electronically or mechanically are: setback acceleration, spin, tube exit, and airflow. Munition fuzes also perform targeting functions, which can include electromagnetic target detection, range estimation, target impact detection, or grazing impact detection.

Many of the above sensing functions can be performed either electronically or mechanically, as several examples may illustrate. First, the velocity change due to setback acceleration during tube launch can be quantified using an accelerometer and an integrating circuit, or by using a mechanical integrator (U.S. Pat. No. 5,705,767). Second, the occurrence of setback acceleration or spin acceleration can be detected with a simple inertial switch, or with an accelerometer and a threshold detection circuit. Third, target impact or grazing impact may be detected using a crush switch, an accelerometer with a threshold circuit, or an inertial switch. The best method to use for any of these functions in a given munition application depends on characteristics of the weapon system such as limitations of size, onboard system power, desired configuration, or on factors such as affordable cost, requirements for safety, or requirements for reliability.

Of the fuzing functions listed above, the present invention can be used to perform launch setback acceleration thresholding; launch setback commencement sensing, for example, to set a "T-zero" timer for the fuze circuit: launch setback characterization, for example, to verify a minimum acceleration pulse duration; launch spin-up detection, for example, locate the switch away from the spin axis and orient it to sense tangentially to respond to angular acceleration; launch spin-threshold switching, for example, locate the switch away from the spin axis and orient it to respond to centrifugal acceleration; target impact switching; omnidirectional graze switching; and impact switching.

The present invention has an advantage in fuzing applications in that, being a normally-open switch, it does not draw power until actuated. This is in contrast to sensor implementations requiring continuous excitation power to operate, for example, to drive the circuit for a capacitive-coupled accelerometer. Thus, because of its extreme miniaturization, omnidirectional sensitivity, low cost, and lack of a requirement for continuous power, the present invention has widespread applications in the fuzing and instrumentation industries. For the same reason, it has numerous industrial, medical-equipment, sports, and transportation applications as well.

To accomplish some of the functions listed above, particularly for fuzing applications, various inertial switches have heretofore been devised. Some prior art devices are described in U.S. Pat. Nos. 6,314,887; 4,916,266; 4,789,762; 4,174,666; and 3,899,649; However, these switches suffer from many disadvantages in the munition fuzing application and in many other applications, as will be delineated. The present invention avoids the disadvantages of previous omnidirectional, uniaxial, or multi-axial-sensitivity inertial switches.

A problem exists in the munition fuzing industry because the need for "smarter" weapons often requires additional space within the weapon for signal and guidance electronics, power management, and sensors, while the need for greater lethality or payload makes simultaneous demands on volume. One solution is in the ultra-miniaturization of existing fuze functions, particularly in the area of mechanical safety and arming. There is also a need to reduce the cost of existing weapon functions to make munition systems more affordable. This need is felt acutely in small- and medium-caliber weapons because of the large numbers needed.

Another aspect of the problem is that with current trends, the domestic precision small-parts manufacturing industry is diminishing or moving overseas, so that an alternative and economical domestic source is needed for future fuze components production. The present invention has the advantage that its manufacture draws on fabrication principles and techniques from the installed domestic infrastructure of the microelectronics industry.

The prior art impact-switch implementations, in general, involve switch configurations that are too bulky, too slow-acting, are imprecise, are too expensive to manufacture, or are difficult or unsuitable to integrate with current surface-mount (hybrid circuit) or multi-chip-module-based fuze circuit implementations. These latter implementation methods are highly desirable to accommodate the aforementioned competing demands for volume in ordnance that must contain increasingly sophisticated fuzing and guidance circuits, as well as larger warheads and payloads. The state of the art as represented by prior art patents is inadequate for applications requiring extreme miniaturization, low cost, electronic integration, and the other advantages stated. Also, current day threshold switches used in fuzing typically involve glass-metal seals or polymeric materials that naturally degrade with time and changing conditions.

In an itemization of problems with the prior art, it is apparent that prior-art switches:

- Are too large for, or do not offer means for, direct integration in multi-chip-modules, surface mount circuits, or even micro-controller chips;
- Are expensive, due to reasons that follow;
- Involve a plurality of parts that must be assembled:
- Involve a domestic precision small-parts manufacturing industry that is shrinking and moving overseas;
- Involve tight clearances and dimensional tolerances that are expensive to fabricate using conventional machining operations;
- Involve dissimilar materials in a way that can reduce the life of the part due to differential thermal expansion, for example, metal-to-glass or metal-to-plastic seals;
- Involve polymeric parts whose material may degrade with time and thermal cycling, or whose function varies with temperature;
- Do not take advantage of recent micro-scale fabrication technologies that use principles and processes well known and widely utilized in the micro-electronic fabrication industry, e.g., optical fabrication masking directly from CAD layouts, optical exposure, chemical developing and rinsing, to create three-dimensional mechanical structures;

Use materials that can corrode.

In summary, there is need for an extremely small, inexpensive, fast-acting, surface-mount- or flip-chip-integratable, tailorable, multi-output impact/torsion switch in military weapons, medical equipment, and industrial and automotive applications.

SUMMARY OR INVENTION

The present invention meets the need for an extremely miniature, very low cost, fast-acting, unpowered, omnidirectional impact switch. In particular, there is a need in the munitions fuzing area for an ultra-miniature, inexpensive, omnidirectional, fast-acting impact-switch, also known as a "g-switch", that can be integrated with a fuze circuit. The need for small size comes from the increasing miniaturization required to pack more functionality into small caliber weapons, e.g., a 20 -mm bursting-round fuze, which also must contain sophisticated timing, sensing or targeting electronics and whose payload must be maximized for effect. This puts space inside the projectile at a premium.

The present invention can function as a "T-zero " switch to initiate processes within a fuze circuit or start a time-from-launch counter or some other function. It can also function as a graze or impact switch for sensing target or ground impact, for purposes such as actuating the firing circuit or starting a self-destruct delay timer or starting a fire-circuit bleed-down timer. The invention can also function as a penetration-layer counter. In addition, there are many non-munition applications for the invention. The threshold values for a particular embodiment of the invention can be set through selection or specification of the gaps or spring rate specified in the layout and assembly drawings. The invention meets the need for an extremely small, surface-mountable, inexpensive omnidirectional impact switch.

The invention has differences that give beneficial results that are not cited in earlier art. These differences are important because:

The invention allows an extreme degree of miniaturization relative to prior-art impact switch implementations.

The invention allows for efficient methods of electrical connection to, and integration with, a circuit. For example, in a fuze application, the invention can be integrated directly with the fuze controller circuit via surface-mount techniques on a hybrid circuit board, or it can be flip-chip integrated directly with fuze ASIC chips, and may in time be possible to integrate on the same substrate with or as part of an ASIC or micro-controller chip itself.

The invention allows for low cost of manufacture by using technology related to the semiconductor wafer and silicon chip manufacturing industry. By virtue of wafer-to-wafer bonding techniques in a semiconductor foundry clean-room environment, and subsequent dicing, the following advantages are obtained:

Simultaneous assembly of hundreds, or thousands, of devices by the joining of two substrate wafers in a wafer-to-wafer bonding process. Wafer-to-wafer bonding in effect accomplishes assembly and electronic packaging in one operation.

Hermetic sealing of the devices.

Extreme cleanliness due to fabrication in a clean-room environment.

Amenability to automated inspection and testing.

Avoidance of the prior art operations of piece-parts manufacture (industrial stamping, drawing, crimping, bonding, welding, sealing, etc.), sorting, handling, and pick-and-place assembly.

The invention can be realized with a variety of sensitivity thresholds depending on specific design factors such as contact gaps, spring stiffness, magnitude of the proof mass, or contact-electrode geometry. The invention allows for different sensitivity levels in different axes, by making modifications to the contact electrodes. The invention also can be configured to provide sensitivity to torsional inputs, and can indicate direction of inputs. Also, the configuration and connection of contacts can allow for sensitivity in only one axis or one direction.

In general, the invention is a normally-open, momentary, non-latching, inertial thresholding switch, fabricated on a substrate in a planar configuration, using no cylindrical tilt mass, with low mass and small switch gap to allow fast switch action and rapid reset. Of rugged construction, its high mechanical frequency limits sensitivity to vibration inputs.

The invention may be extremely small (about 1 cubic mm), integratable with electronics, surface-mountable, rugged, cheap and fast-acting. The invention does not draw power, has a large dynamic range, has different sensitivity in different axes, and can be ganged with identical sensors or an array of sensors with different thresholds on the same substrate. The invention offers a number of improvements over the prior art:

It incorporates a monolithic, micro-machined, integral mass-and-spring, fabricated and integrated simultaneously on a planar substrate with its electrical contacts, assembled with a one-piece cover plate in a wafer-scale assembly process, individuated from the whole by dicing. This is a fundamentally different approach for a miniature g-switch than has been done before.

It has a suspension spring formed in lithographic or lithographic-derived process, integral with the proof mass.

It has a centrally-located mechanical anchor and peripheral proof mass (unique configuration).

It is simple, i.e., a MEMS device on a substrate plus a cover plate.

It is free from the cylindrical tilting-mass approach of prior designs.

Its actuation mechanism does not require "tilting" of a cylindrical mass, with the associated moments of inertia, hence, it can act faster.

The switching gap can be extremely small, leading to fast switching action of less than 200 microseconds.

The approximate size of the assembled embodiments is 1 -mm×1 -mm on substrate with a thickness of 500 to 1000 microns, for a total volume of 1 to 5 cubic mm, compared with 90–500 cubic mm for prior art switches.

Approximately 2,000 to 10,000 devices can be fabricated on an 8" wafer substrate.

As a MEMS-fabricated device, it is its own "housings " and hermetic seal.

The configuration of a center-supported spring/mass assembly optimizes the size of proof mass relative to overall device footprint and also makes it easy to run contact leads around the outside of the mass and simplifies fabrication (no need to deposit tracks and then insulate them from the mass).

The invention will be better understood, and further objects, features, and advantages thereof will become more apparent from the following description of the preferred embodiments, taken in conjunction with the accompanying drawings.

BRIEF DESCRIPTION OF DRAWINGS

In the drawings, which are not necessarily to scale, like or corresponding parts are denoted by like or corresponding reference numerals.

FIGS. 1*a*, 1*g* and 1*h* are plan views that show steps in the formation of the substrate die. FIGS. 1*b*–1*f* are sections along the line A—A in FIG. 1*a* that show steps in the formation of the substrate die.

FIGS. 2*a*, 2*b*, 2*d* and 2*e* are plan views. FIGS. 2*c* and 2*f* are sections.

DETAILED DESCRIPTION

The invention relates to an ultra-miniature electromechanical inertial switch of the normally open type wherein inertial loads due to impact, axial acceleration, or centrifugal acceleration can be threshholded and detected by means of switch closure, and wherein integration of the switch mechanism with electronics can be accomplished by surface mount technology or flip-chip integration. The prime application of this switch is in munition fuze safety and arming for gun-launched munitions, wherein launch (setback) acceleration or spin-induced centrifugal acceleration can be detected and thresholded by the switch, or the switch can function in the munition as a tamper switch, a set forward switch, a graze switch, or a target impact switch.

First Embodiment

Figure 1A:
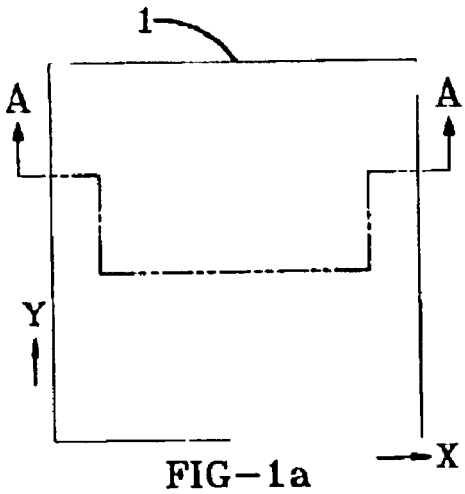
FIGS. 1*a*–1*h* show the process of defining features on a substrate die.
Figure 1B:
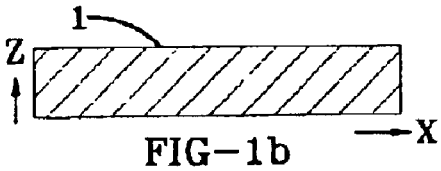

The first embodiment of the invention is an omnidirectional g-switch having four electrodes, including one input electrode and three output electrodes. FIGS. 1*a*–*h* show the substrate die 1. The substrate die 1 is part of a wafer used in device replication technology that uses pattern transfer, deposition, developing, or related processes on a wafer scale. Axis reference directions x, y and z are indicated in FIGS. 1*a* and 1*b*, with z being orthogonal to x and y.

Figure 1C:
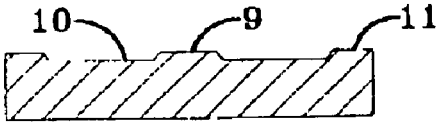

The substrate die is shown in plan view in FIG. 1*a* and in section view in FIG. 1*b*. It is noted that each of the sections in FIGS. 1*b*–*f*, FIGS. 2*c*, 2*f*, 3*c*, 4*c*, 4*f* and 5*c* are taken along a line that coincides with line A—A in FIG. 1*a*. As shown in FIG. 1*c*, substrate die 1 is patterned (pattern not shown) and etched using common micromachining techniques such as bulk etching to create a trough area 10, a pedestal 9 whose top surface corresponds to the original top surface of the die, and a perimeter "land" area 11 also corresponding to the original top surface of the die.

Figure 1D:
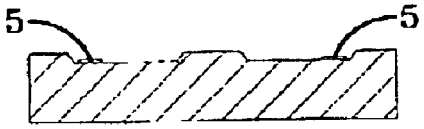
Figure 1E:
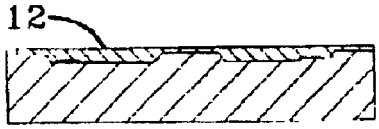
Figure 1F:
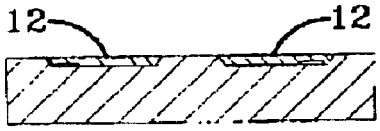
Figure 1G:
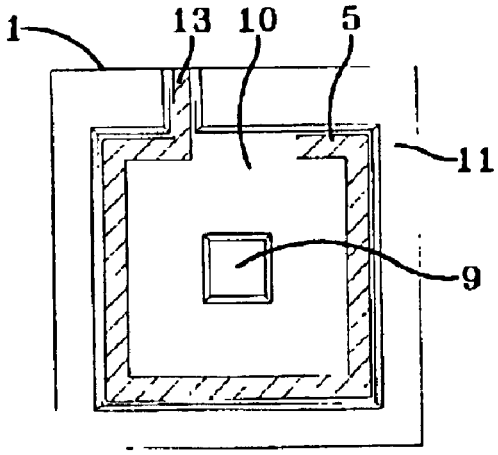

FIG. 1*d* and 1*g* show a bottom ring electrode 5 with contact lead 13. Bottom ring electrode 5 is a metallization pattern that has been grown or deposited in the trough 10 of die 1. Shown in a plan view, the die 1 now looks as shown in FIG. 1*g*.

Figure 1H:
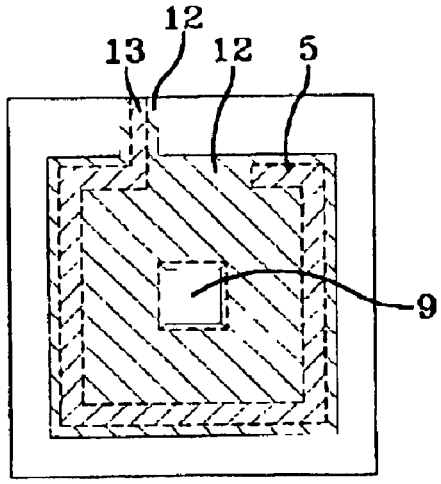

FIG. 1*e* shows a planarization filler material 12 deposited on the surface of the wafer, hence also on each individual die such as die 1. Planarization filler material 12 fills in the trough area 10 and also covers the entire die 1. Filler material 12 is selected to provide a planar surface for later operations, while also being chemically removable later. In FIG. 1*f*, the fill material 12 has been mechanically planarized to be flush with the top surface of the die 1. FIG. 1*h* shows the final configuration of the die 1 in plan view. Substrate die 1 is the substrate surface for the operations that follow.

Figure 2A:
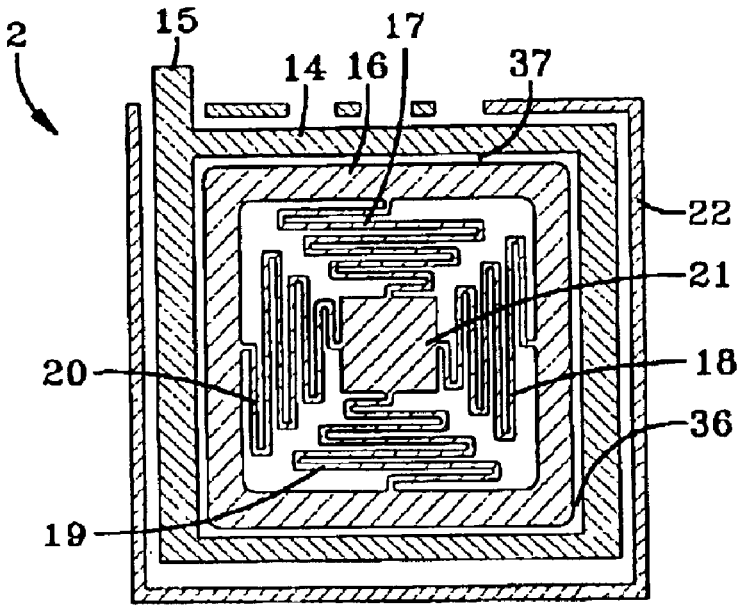
FIGS. 2*a*–2*f* show the preparation of the device layer of a first embodiment and its addition to the substrate die and also show the basic features of a cover plate.

FIG. 2*a* shows a pattern formed of metal or-other conductive material through micro-electro-mechanical systems (MEMS) type micromachining processes. FIG. 2*a* represents the optical pattern used in micromachining processes to fabricate the device layer 2 of conductive material, which is in effect a metal cutout or conductive pattern of certain thickness in the z-axis . In practice, the device layer 2 will, in addition to the metal (or otherwise conductive) pattern, have a filler matrix 40 (FIG. 2*c*) that holds everything in place temporarily and that can later be removed. For clarity, however, FIGS. 2*a* and 2*b* do not show the filler matrix 40, which is shown in FIG. 2*c*.

Figure 2B:
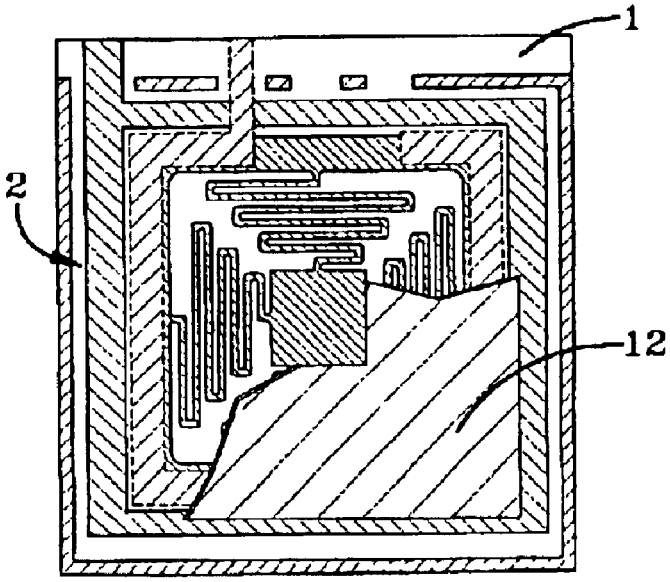
Figure 2C:
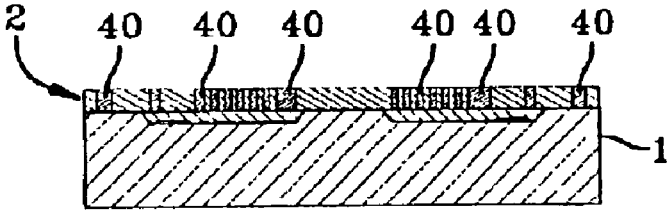
Figure 2D:
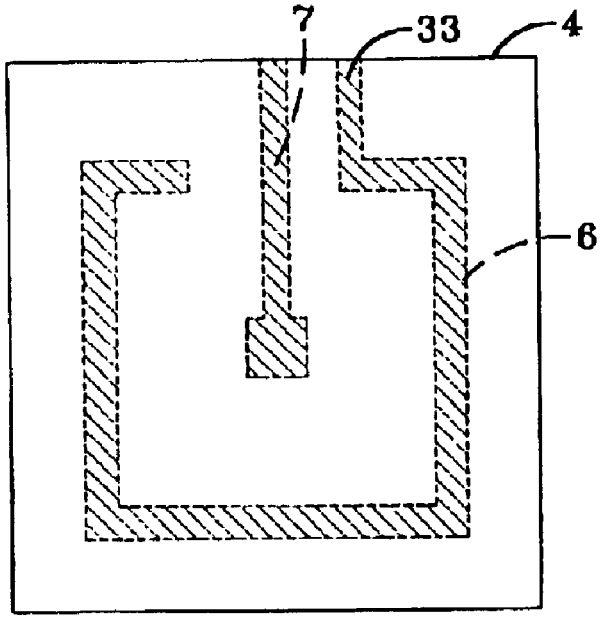

FIG. 2*b* shows the partial assembly of the first embodiment wherein device layer 2 has been bonded to the top of the evolved substrate die 1 shown in FIG. 1 *h*. FIG. 2*c* is a section view of the combined parts shown in FIG. 2*b*. Once this assembly has been made, the filler matrix 40 and the planarization layer 12 are dissolved out or otherwise removed to create a cavity under device layer 2. The cavity allows the features of device layer 2 the desired freedom of motion, as shown in FIG. 2*f*. There is now a mechanical gap between the formed proof mass 16 and bottom ring electrode 5. This gap is bottom gap 38.

Figure 2E:
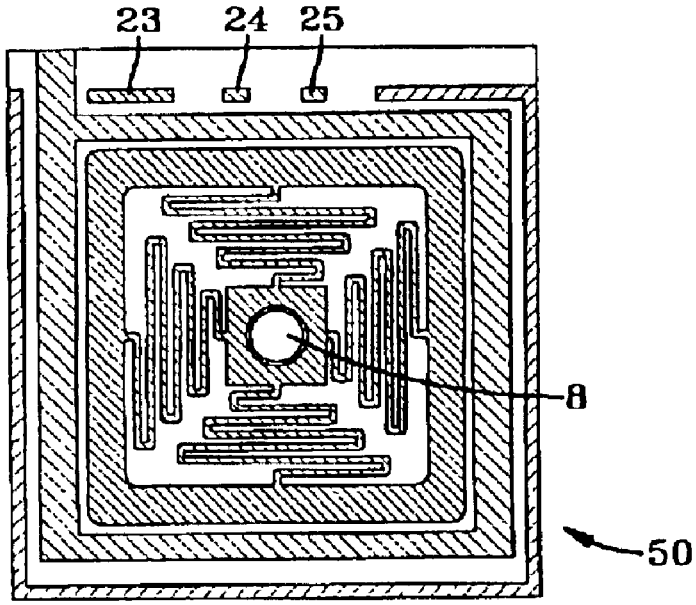
Figure 2F:
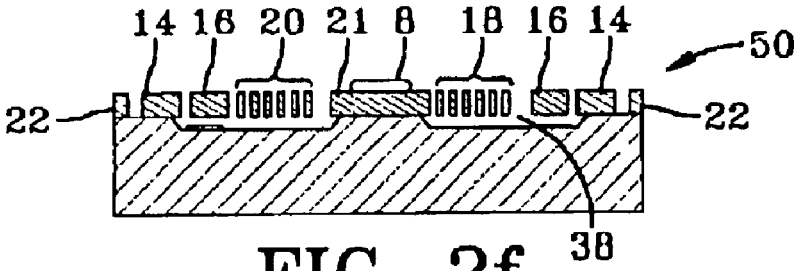

When a conductive link 8 (for example, a solder ball) is added to the assembly of FIG. 2*b*, the result is the assembly of FIGS. 2*e* (plan view) and 2*f* (cross-section). The assembly of FIGS. 2*e* and 2*f* is called the bottom switch assembly 50.

FIG. 2*a* also shows other features, including a square-shaped "annular" proof mass 16 that is connected by springs 17, 18, 19, and 20 to an anchor 21. Anchor 21 is adhered to the top of pedestal 9. The mass 16 is suspended by this arrangement in a three-dimensional cavity such that there are mechanical gaps between the proof mass 16 and contact electrodes 5, 6 and 14. The x-axis gap is labeled 36, the y-axis gap is labeled 37.

Figure 3A:
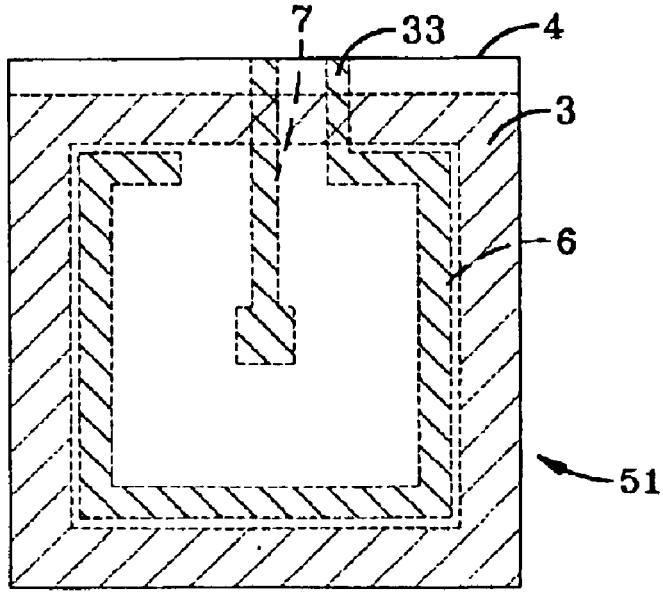
FIG. 3*a* is a plan view of the cover plate assembly.

FIG. 2*d* shows a top plate 4 that matches the footprint of die 1. Top plate 4 has conductive tracks deposited or fabricated on the underside of the plate. These conductive tracks are top ring electrode 6 and center electrode 7. To this is added a spacer 3 (FIG. 3*a*) of certain thickness and of non-conductive material, positioned on the underside of the top plate 4. The combination of the top plate 4, the electrodes 6 and 7, and the spacer 3, shown in FIG. 3*a*, is the cover plate assembly 51.

Assembly of the invention device occurs when the cover plate assembly 51 is positioned over the bottom switch assembly 50, and they are pressed and bonded together. The action creates a top mechanical gap 39 (FIG. 3*c*), between proof mass 16 and top electrode 6. This action also presses conductive link 8 to make electrical contact between anchor 21 and center electrode 7. The gap 39 is determined by the thickness of the spacer 3, and may not be the same as gap 38, if different switch thresholds are desired in the plus and minus z directions.

Figure 3B:
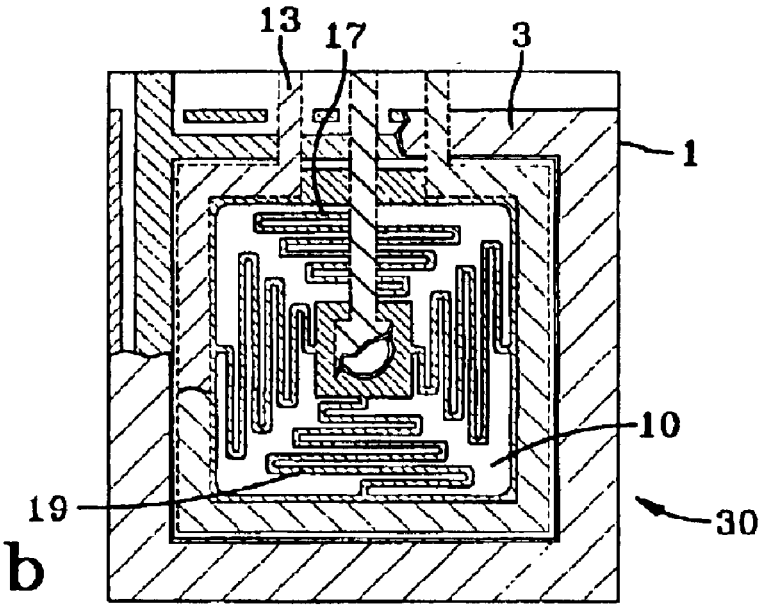
FIG. 3*b* is a plan view of a first embodiment of the assembled switch and FIG. 3*c* is a section view of the first embodiment of the assembled switch.
Figure 3C:
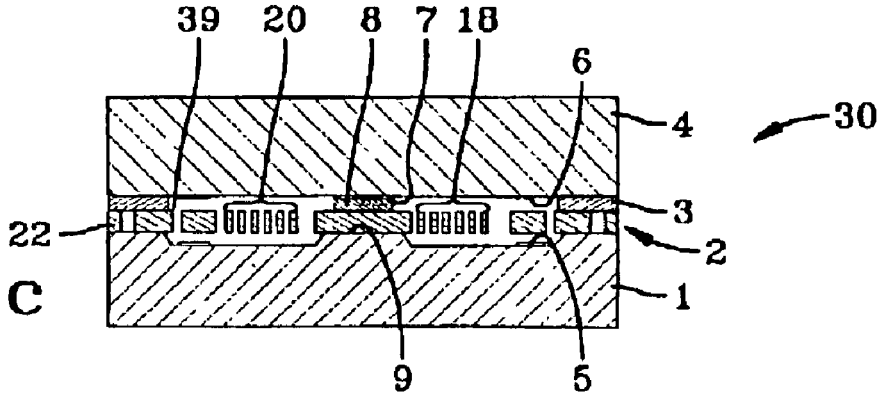

The final assembled switch 30 is shown in the plan view of FIG. 3*b* (top plate 4 is made invisible) and the section view of FIG. 3*c* (shown with top plate visible). Electrical connection of the switch 30 to a load or detection circuit is via the input center electrode 7 and the output electrode contacts 13, 15, and 33, which are connected to electrodes 5, 14, and 6, respectively. Additional features that were fabricated as part of device layer 2 include elements 22, 23, 24, and 25. Elements 22, 23, 24, and 25 provide structural support to the assembly and a partial seal of the switch 30.

The preferred way to assemble the invention is in "wafer scale" assembly. In "wafer scale" assembly, a whole wafer of bottom switch assemblies 50, on the order of 2000 to 10000 units per wafer, is sandwiched with a whole wafer of cover plate assemblies S1, so that assembly of thousands of devices occurs in one step. Once the wafers are in position, various techniques of wafer-to-wafer bonding may be used to adhere and seal the devices. After wafer-to-wafer bonding, the individual devices are separated by dicing, in a common microchip dicing operation.

Operation of First Embodiment

The assembled switch 30, shown in plan view in FIG. 3*b* and section view in FIG. 3*c*, is an omnidirectional, ultra-miniature impact switch or "g-switch." The proof mass 16 is held in place by spring suspension set 17, 18, 19, and 20. Under a sufficient inertial impact load in the x-axis, the x-axis gap 36 between the proof mass 16 and the ring electrode 14 will be momentarily closed, since they are in the same plane. This momentary closure will be electrically detectable as continuity from the input electrode 7, through the conductive link 8 and the conductive anchor 21, spring set 17–20, and proof mass 16, to the output contact 15 of ring electrode 14, thus closing the switch 30. The same thing happens due to a sufficient inertial load in the y-axis, wherein the proof mass 16 is induced to move relative to the contact electrode 14 to close contact gap 37, with the switch closure similarly sensed across input electrode 7 and output contact 15.

When a sufficient inertial load is received in a given direction along the z-axis, the proof mass 16 is deflected downward to make contact with bottom ring electrode 5, and when the inertial load is received in the opposite z-axis direction, the proof mass 16 makes electrical contact with the top ring electrode 6, so that switch closure is sensed across input electrode 7 and output contacts 13 and 33, respectively. Oblique impacts will result in a superimposition of the above contact modes, so that switch closure will be detected as continuity between input lead 7 and one or more of the output electrode leads 13, 15, and 33.

Due to the smallness of the contact gaps 36, 37, 38, and 39, which may be on the order of 25 microns (0.001 inches) (or in a range of about 0.01 to about 0.0001 inches), switch closure under the intended fuze applications will occur in less than 50 microseconds (0.000050 seconds). Switch closure will be momentary, i.e., for as long as the inertial loading continues, and after one closure the switch 30 will reset for the next input detection.

Second Embodiment

The second embodiment is an omnidirectional g-switch having seven electrodes and able to provide more directional information than the first embodiment. Many of the features of the second embodiment, however, are identical to those of the first embodiment. Where this is so, the same feature designations and reference numerals are used.

Construction of the substrate die 1, shown in FIGS. 1*a*–*h*, is identical to that for the first embodiment, and is not repeated here. The construction of the remainder of the second embodiment is essentially the same as for the first embodiment except that the contact electrode 14 has been separated into four corner electrodes as follows, with orientation referenced to the extents of the x and y axes: the (−x,+y) corner electrode 41 and its contact, 42; the (−x,−y) corner electrode 43 and its contact, 44; the (+x,+y) corner electrode 45 and its contact, 46; the (+x,−y) corner electrode 47 and its contact, 48. The purpose of this arrangement is to glean directional information in the x-y plane about an impact loading by observing the order in which electrical contact is made among the six output electrodes (5, 6, 41, 43, 45, and 47).

For example, an impact coming from the +x axis will cause the proof mass to make essentially simultaneous contact with electrodes 45 and 47. Similarly, an impact that comes along the plus x=y line will cause the proof mass 16 to make first contact with corner electrode 45, or, more strictly, simultaneous contact with electrodes 43, 45, and 47. This indicates in a rough way the direction of the impact, which can provide useful information. There is a similar explanation of the order of contact for impacts coming from other directions in the x-y plane. Add to this the information, already discussed with regard to the first embodiment, about making of contact with the top or bottom electrodes, and one can obtain information about the quadrant in which the impact was received (e.g., an impact along a line x=y=z will tend to cause the proof mass 16 to make simultaneous contact with electrodes 45 and 6).

Also, a second contact mode is now possible, in that the second embodiment can also detect torsion. A rotational acceleration or torsion applied around the z-axis will cause simultaneous contact of the proof mass 16 with corner electrodes 41, 43, 45, and 47.

Yet a third contact mode provides information when an impact involves an angular acceleration or torsion around any axis passing through the center of the device in the x-y plane. Such a torsion will cause the proof mass 16 to rotate on its suspension, out of the x-y plane, to bring one side into contact with the bottom electrode 5 and the other side into contact with the top electrode 6.

Thus, in summary, by observing the timing and order of contact closure among the six output electrodes (5, 6, 41, 43, 45, and 47) in the switch of the second embodiment, the quadrant or direction from which an inertial input is received, or the axis about which a torsional acceleration occurs, can be deduced, and more than one inertial input event can be observed simultaneously. The interpretation of the closure pattern can be accomplished with logic programmed into a microcircuit. The logic for evaluating the pattern will be readily apparent to one skilled in the programming art, and is not presented here.

Figure 4A:
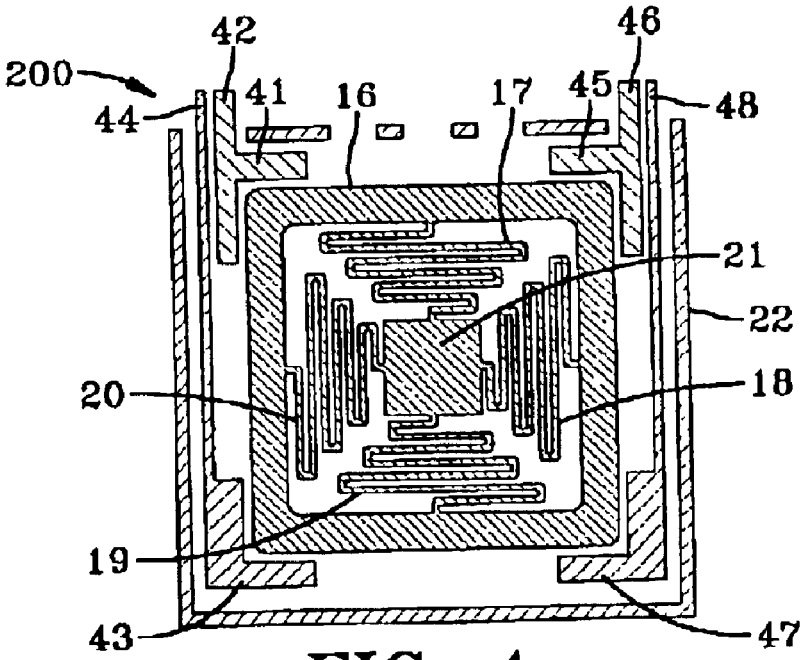
FIGS. 4*a*–4*f* show the preparation of the device layer of a second embodiment and its to the substrate die and also show the basic features of a cover plate.

FIG. 4*a* shows a pattern formed of metal or other conductive material through micro-electro-mechanical systems (MEMS) type micromachining processes. FIG. 4*a* represents the optical pattern used in micromachining processes to fabricate the working device 200 of conductive material, which is in effect a metal cutout or conductive pattern of certain thickness in the z-axis. In practice, the device layer 200 will, in addition to the metal (or otherwise conductive)

pattern, have a filler matrix 49 that holds everything in place temporarily and that can later be removed. For clarity, however, FIGS. 4*a* and 4*b* do not show the filler matrix 49, which is shown in FIG. 4*c*.

Figure 4B:
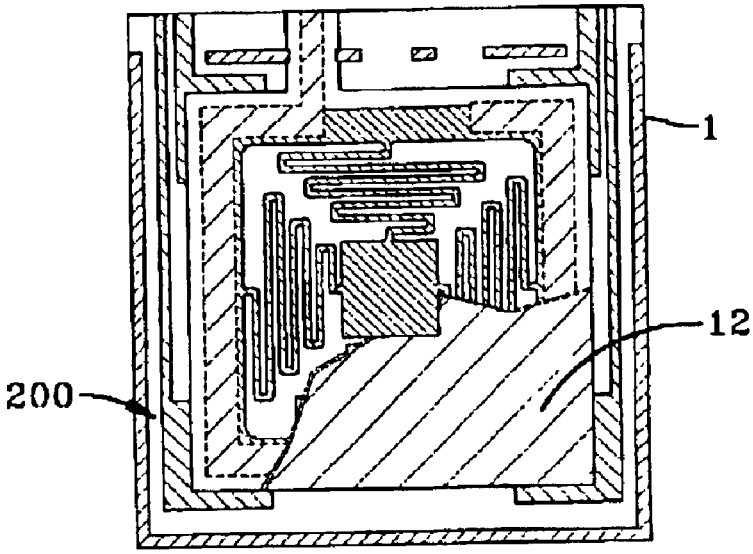
Figure 4C:
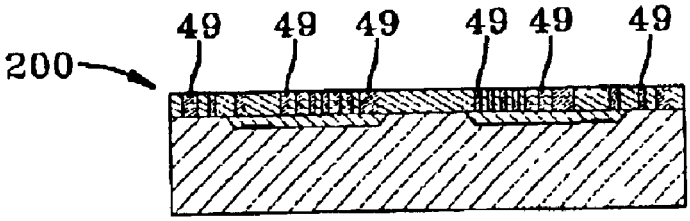
Figure 4D:
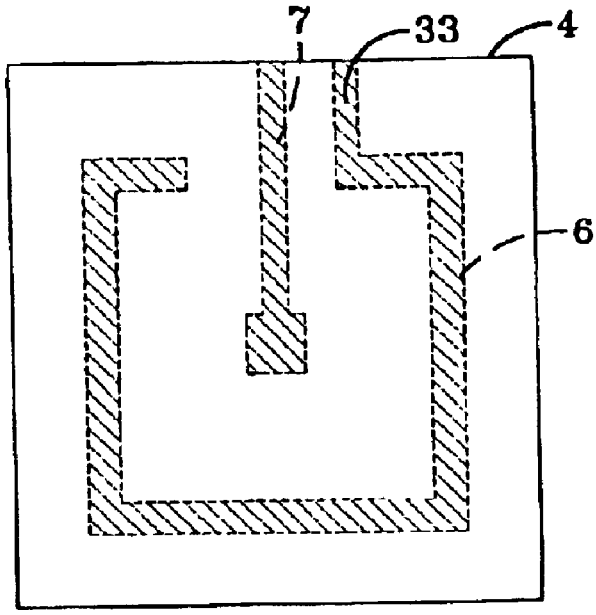

FIG. 4*b* shows the partial assembly of the second embodiment wherein device layer 200 has been bonded to the top of the evolved substrate die 1 shown in the configuration of FIG. 1 *h*. A section view of the combined parts is shown in FIG. 4*c*. Once this assembly has been made, the filler matrix 49 and the planarization layer 12 are dissolved out or otherwise removed to create a cavity under device layer 200. The cavity allows the features of device layer 200 the desired freedom of motion, as shown in FIG. 4*f*. There is now a mechanical gap between the formed proof mass 16 and bottom electrode 5. The bottom gap is labeled 38.

Figure 4E:
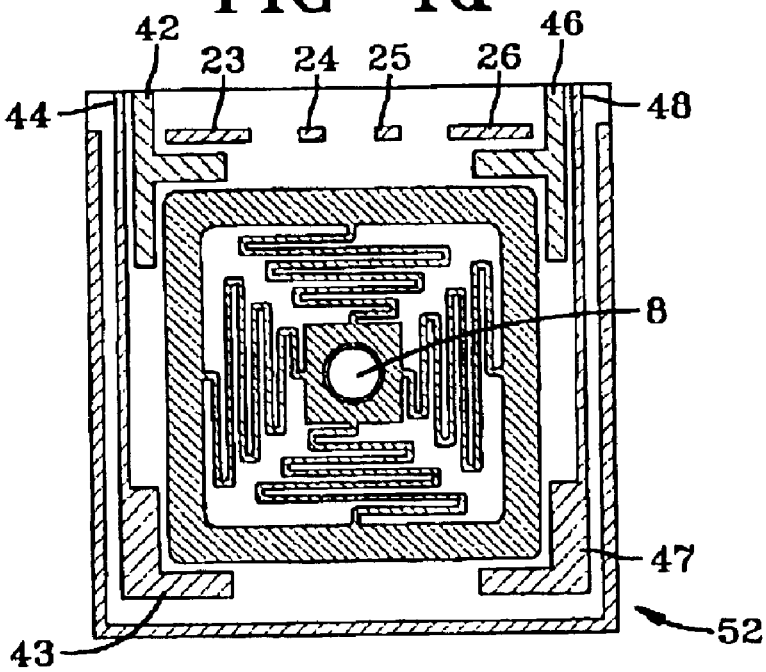
Figure 4F:
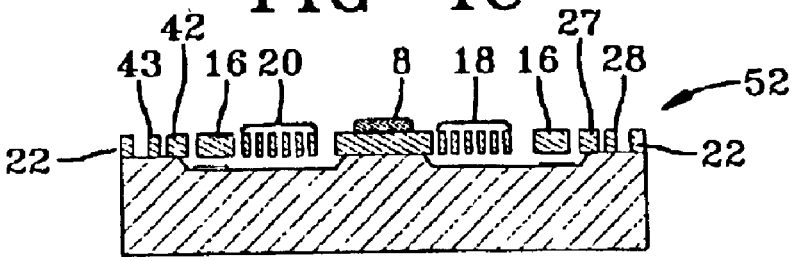

When a conductive link 8 (for example, a solder ball) is added to the assembly of FIG. 4*b*, the result is the assembly of FIGS. 4*e* (plan view) and 4*f* (cross-section). The assembly of FIGS. 4*e* and 4*f* is called the bottom switch assembly 52.

FIG. 4*a* also shows other features, including a square-shaped "annular" proof mass 16 that is connected by springs 17, 18, 19 and 20 to an anchor 21. Anchor 21 is adhered to the top of pedestal 9. The mass 16 is suspended by this arrangement in a three-dimensional cavity such that there are mechanical gaps between the proof mass 16 and contact electrodes 5, 6, 41, 43, 45 and 47. The x-axis gap is labeled 36, the y-axis gap is labeled 37.

Figure 5A:
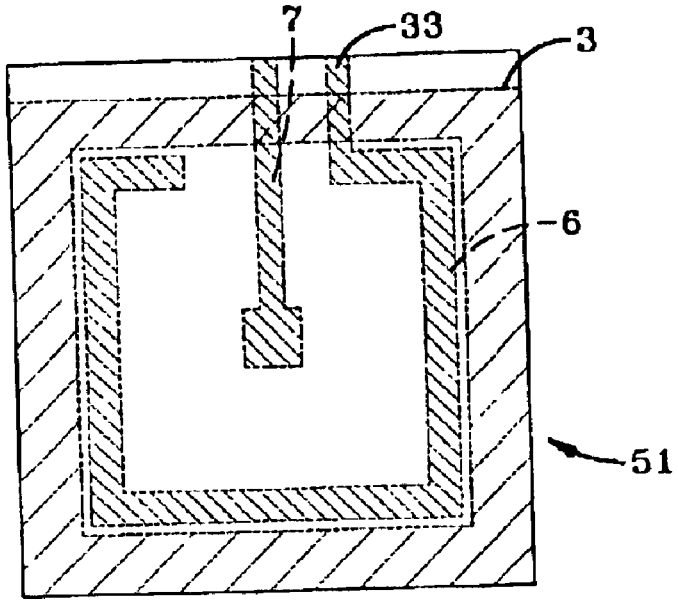
FIG. 5*a* is plan view of the cover plate assembly.

FIG. 4*d* shows a top plate 4, identical to that used in the first embodiment, that matches the footprint of die 1 and which has conductive tracks deposited or fabricated on the underside of the plate 4. These conductive tracks are top ring electrode 6 and center electrode 7. To this is added a spacer 3 of non-conductive material, positioned on the underside of the top plate, as shown in FIG. 5*a*. The combination of the top plate 4, the electrodes 6 and 7, and the spacer 3, shown in FIG. 5*a*, is identified as the cover plate assembly 51.

Assembly of the second embodiment occurs when the cover plate assembly 51 is positioned over the bottom switch assembly 52, and they are pressed and bonded together. The action creates a top mechanical gap 39, this time between proof mass 16 and top electrode 6. This action also presses conductive link 8 to make electrical contact between anchor 21 and center electrode 7. The gap 39 is determined by the thickness of the spacer 3, and may not be the same as gap 38, if different switch thresholds are desired in the plus and minus z directions.

Figure 5B:
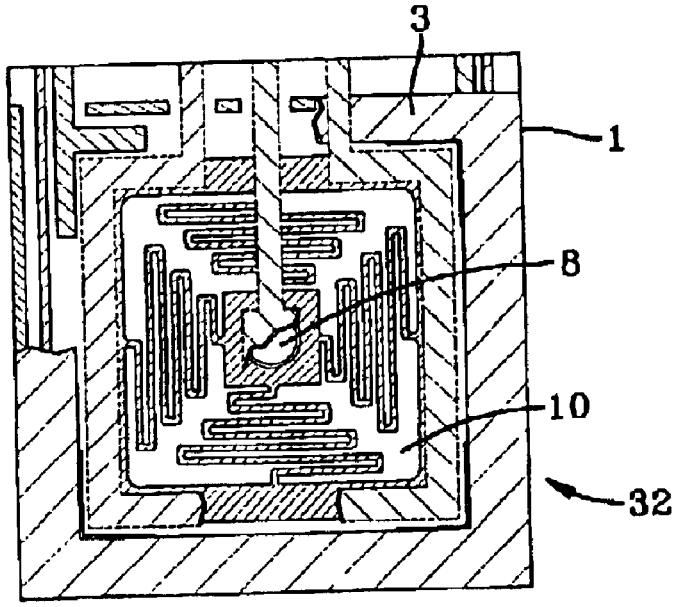
FIG. 5*b* is a plan view of a second embodiment of the assembled switch and FIG. 5*c* is a section view of the second embodiment of the assembled switch.
Figure 5C:
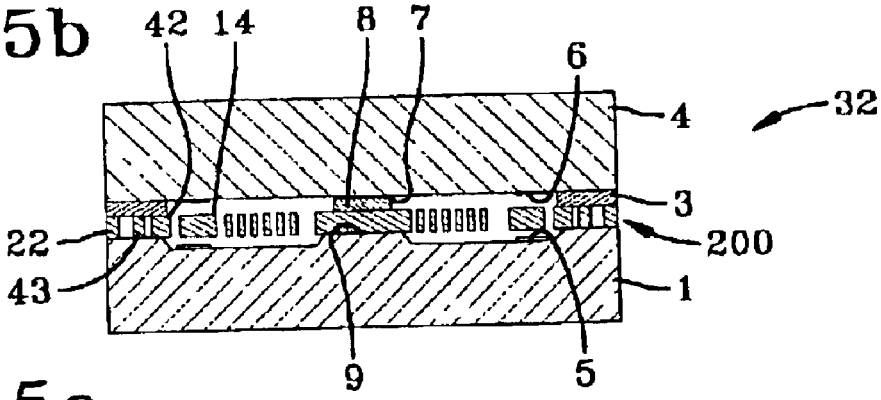

The final assembled switch 32 is shown in plan view in FIG. 5*b* (top plate 4 is made invisible) and in section view in FIG. 5*c*. Electrical connection of the switch 32 to a load or detection circuit is via the input center electrode 7 and the output electrode contacts 13, 33, 42, 44, 46, and 48. Additional features that were fabricated as part of device layer 200 include elements 22, 23, 24, and 25. Elements 22, 23, 24, and 25 provide structural support to the assembly and a partial seal of the switch 32.

The preferred way to assemble the invention is in "wafer scale" assembly. In "wafer scale" assembly, a whole wafer of bottom switch assemblies 52, on the order of 2000 to 10000 units per wafer, is sandwiched with a whole wafer of cover plate assemblies 51, so that assembly of thousands of devices occurs in one step. Once the wafers are in position, various techniques of wafer-to-wafer bonding may be used to adhere and seal the devices. After wafer-to-wafer bonding, the individual devices are separated by dicing, in a common microchip dicing operation.

OTHER EMBODIMENTS

Other embodiments of the present invention can be envisioned that use a different pattern for the suspension springs, or a different shape of the proof mass, for example a varying thickness in the square proof mass, or perhaps a circular proof mass with a circular contact electrode, etc., but these are the same invention. A setback-hardened design would reduce or eliminate gap 38 and bottom contact electrode 5. With developments in the industry it will be possible to form most or all of the features of device layers 2 and 200 in the aforementioned embodiments by advanced molding or hot-embossing mold transfer processes instead of a direct micromachining technique. For example, the micromachining operation can be used to create a master mold that is then used to "print" molds for the electroplating of the product devices.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An omnidirectional inertial switch, comprising:

a substrate die including a centrally located pedestal, a trough area surrounding the pedestal, a perimeter land area surrounding the trough area, a bottom ring electrode disposed in the trough area and a contact lead connected to the bottom ring electrode;

a bottom switch assembly disposed on the substrate die, the bottom switch assembly including a conductive device layer and a conductive link, the device layer including a centrally located anchor, at least one spring, a proof mass connected to the anchor by the at least one spring and located opposite the bottom ring electrode, at least one contact electrode disposed radially outward from the proof mass and a contact lead connected to the at least one contact electrode, the conductive link being disposed on the anchor; and a cover plate assembly disposed on the bottom switch assembly, the cover plate assembly including a top plate, a non-conductive spacer disposed between the top plate and the bottom switch assembly, a center electrode that contacts the conductive link and a top ring electrode located opposite the proof mass; wherein an x-axis gap and a y-axis gap are defined between the proof mass and the at least one contact electrode, a bottom z-axis gap is defined between the bottom ring electrode and the proof mass and a top z-axis gap is defined between the top ring electrode and the proof mass.

2. The switch of claim 1 wherein the conductive link comprises a solder ball.

3. The switch of claim 1 wherein a thickness of the pedestal and a thickness of the perimeter land area are the same.

4. The switch of claim 1 wherein the at least one spring comprises four springs.

5. The switch of claim 1 wherein the at least one contact electrode is a single contact electrode and wherein the single contact electrode surrounds the proof mass.

6. The switch of claim 1 wherein the proof mass has a shape of an annular square.

7. The switch of claim 6 wherein the at least one contact electrode comprises four separate contact electrodes, each of the four contact electrodes connected to a respective contact lead, and wherein the four contact electrodes are located at respective comers of the proof mass.

8. The switch of claim 1 wherein the top and bottom z-axis gaps are the same.

9. The switch of claim 1 wherein the top and bottom z-axis gaps are different.

10. The switch of claim 1 wherein the x, y and z-axis gaps are in a range of 0.0001 inches to about 0.01 inches.

11. The switch of claim 1 wherein the switch is normally open.

12. The switch of claim 1 wherein a size of the switch is in a range of one cubic mm to about five cubic mm.

* * * * *